US008875323B2

(12) United States Patent
Westra et al.

(10) Patent No.: US 8,875,323 B2
(45) Date of Patent: Nov. 4, 2014

(54) PORTABLE COLLAPSIBLE FIELD HOSPITAL BED

(71) Applicant: North American Rescue, LLC, Greer, SC (US)

(72) Inventors: Matt Westra, Simpsonville, SC (US); Anthony Horton, Mauldin, SC (US); Matthew Cupelli, Greer, SC (US)

(73) Assignee: North American Rescue, LLC, Greer, SC (US)

( * ) Notice: Subject to any disclaimer, the term of this patent is extended or adjusted under 35 U.S.C. 154(b) by 0 days.

(21) Appl. No.: 14/093,485

(22) Filed: Dec. 1, 2013

(65) Prior Publication Data

US 2014/0150183 A1 Jun. 5, 2014

Related U.S. Application Data

(60) Provisional application No. 61/733,313, filed on Dec. 4, 2012.

(51) Int. Cl.
*A61G 1/013* (2006.01)

(52) U.S. Cl.
USPC ..... 5/110; 5/620

(58) Field of Classification Search
USPC ..... 5/110–114, 620, 634, 174, 202
See application file for complete search history.

(56) References Cited

U.S. PATENT DOCUMENTS

| | | | | |
|---|---|---|---|---|
| 1,257,984 | A | 5/1918 | Drexler | |
| 3,965,502 | A * | 6/1976 | Bertram | 5/111 |
| 4,685,160 | A | 8/1987 | Rizzardo | |
| 6,035,468 | A * | 3/2000 | Lee | 5/174 |
| 6,253,396 | B1 * | 7/2001 | Weston | 5/110 |
| 8,132,277 | B2 * | 3/2012 | Buchanan | 5/627 |

* cited by examiner

*Primary Examiner* — Fredrick Conley
(74) *Attorney, Agent, or Firm* — McNair Law Firm, P.A.; Douglas W. Kim

(57) ABSTRACT

The present invention is a collapsible portable field hospital bed that can be transported to remote location and is durable enough to remain at the remote location for subsequent local use. The invention can include a frame having a horizontal support assembly including a proximal end and a distal end hingably connected so that the proximal end and the distal end can be moved from an operational position to a storage position; a vertical support assembly pivotally connected to an angled support assembly and said horizontal support assembly, said angled support assembly pivotally connected to said horizontal support assembly; a stabilizing assembly included in said frame having a first hinge member pivotally attached to a second hinge member, said stabilizing assembly biased in said operational position, said first hinge member cooperating with said second hinge member to prevent said angled support assembly from folding.

20 Claims, 7 Drawing Sheets

PORTABLE COLLAPSIBLE FIELD HOSPITAL BED

FIELD OF THE INVENTION

This invention is directed to a field hospital bed and more specifically to a portable collapsible field hospital bed. The hospital field bed is collapsible so that it can be transported to remote location and sufficiently durable so that when the use is completed by the transporting entity, the bed can be left in field for subsequent use. This is a non-provisional patent application of U.S. Provisional Patent Application 61/733,313 filed Dec. 4, 2012.

BACKGROUND OF THE INVENTION

In remote locations especially with disaster, civil unrest or war time activities, it is advantageous to have medical facilities with beds for injured individuals for the individual to rest, receive medical treatment and other needs. These medical facilities are needed quickly and are generally temporary. When the event requiring the bed is completed, the medical facilities, and the beds, are typically packed and transported to another needed location or the majority of the time are abandoned in the field. There is a need for a more transportable field bed that is sufficiently durable so that when the event that requires the bed is completed, the bed can be left in the field for subsequent use by others, for example a local hospital.

Transporting the beds to and from the remote facility can be time consuming and costly as most beds have a large footprint. Further, it is desirable for beds to include supports that support a pad off the ground both for comfort as well as when the bed is used for providing medical treatment. It is also desirable that the bed be portable, collapsible and provide a stable support surface. Preferably, the support surface can be flat and transition into a upright position to support the individual in a sitting-up position.

One attempt to provide a field bed is shown in U.S. Pat. No. 1,257,984. However, this attempt does not support the bed at a height advantageous for providing medical treatment, is an unstable (swinging) platform and requires standards to penetrate the ground. U.S. Pat. No. 4,685,160 discloses a portable bed that can be disassembled for transportation and storage. However, this attempt involves a complex undercarriage, disassembles into parts increasing the potential that an incomplete bed to be shipped to the field and includes motors for moving the bed into multiple positions.

Therefore, it is an object of the present invention to provide for a field hospital bed that can be easily transported to a remote location, used as a bed in a temporary medical facility with sufficient strength and durability to be converted in to bed for subsequent use once the need for the bed is completed.

SUMMARY OF THE INVENTION

The objects of the present invention are achieved by providing a portable collapsible field hospital bed comprising: a frame having a horizontal support assembly and a pad support assembly wherein the frame has an operational position and a storage position; a vertical support assembly pivotally attached to an angled support assembly and the horizontal support assembly, the vertical support assembly including a first vertical support assembly cross member and a second vertical support assembly cross member, the angled support assembly including a first angled support assembly cross member and a second angled support assembly cross member; a pad for supporting a patient carried by the pad support assembly; a stabilizing assembly having a first hinge member pivotally attached to the second vertical support assembly cross member and a second hinge member, the second hinge member pivotally attached to the second angled support assembly cross member, the stabilizing assembly biased in an operation position by a biasing member included in the stabilizing assembly; and, a standard having a first standard member received within a second standard member so that the first standard member and the second standard member telescope, the first standard member pivotally attached to the pad support assembly and the second standard member attached to the firs angled support assembly cross member.

The invention can include an actuator for the standard having a locked position and an unlocked position wherein in the unlocked position, the first standard member and the second standard can slide within each other to vary the overall length of the standard. Side rails carried by the horizontal support assembly wherein the side rails can be lowered to allow access to the pad by a patient. Angled side rail supports can be attached to the horizontal support assembly and pivotally attached to the side rails. The angled side rail supports are disposed at an angle greater than 90° to a plane perpendicular to the horizontal support assembly. A side rail lock assembly can be included for locking the side rail in the raised position.

The invention can include a proximal end and a distal end on the frame and a hinge pivotally connecting the proximal end with the distal end so that in the frame can be moved between the operational position and the storage position. Interlocking teeth can be included in the hinge to provide stability to the frame when the frame is in the operational position. An accessory opening can be defined in the horizontal support assembly for receiving accessories; and, an IV pole accessory received in the accessory opening for support IV bags. A mid-frame accessory opening can be included in the hinge for receiving an accessory and a tray received in the mid-frame accessory opening.

BRIEF DESCRIPTION OF THE DRAWINGS

The invention will be better explained and understood with reference to the following drawings.

DETAILED DESCRIPTION OF THE PREFERRED EMBODIMENT

Figure 1:
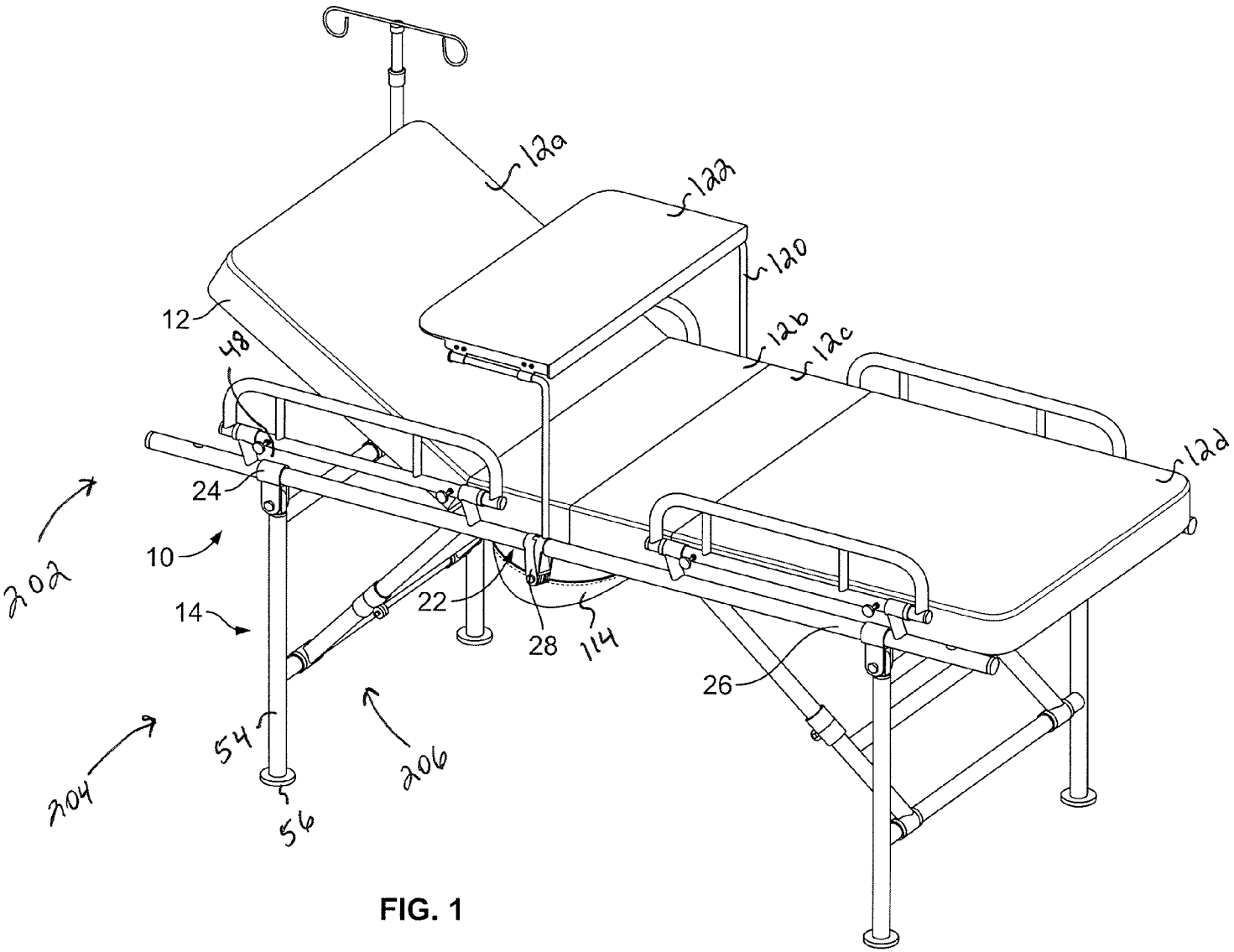
FIG. 1 is a perspective view of the invention.

Referring to FIG. 1, a field hospital bed is shown as 10. A pad 12 is removable attached to a frame 14. The frame can include, at each end, a pad support assembly 200, a horizontal support assembly 202 and a vertical support assembly 204. Each end of the frame can include a pad support assembly, horizontal support assembly and vertical support assembly. The pad is supported by the pad support assembly and the vertical support assembly supports the frame and pad, and therefore a patient, above the ground. FIG. 1 shows the bed in an operational position.

Figure 2:
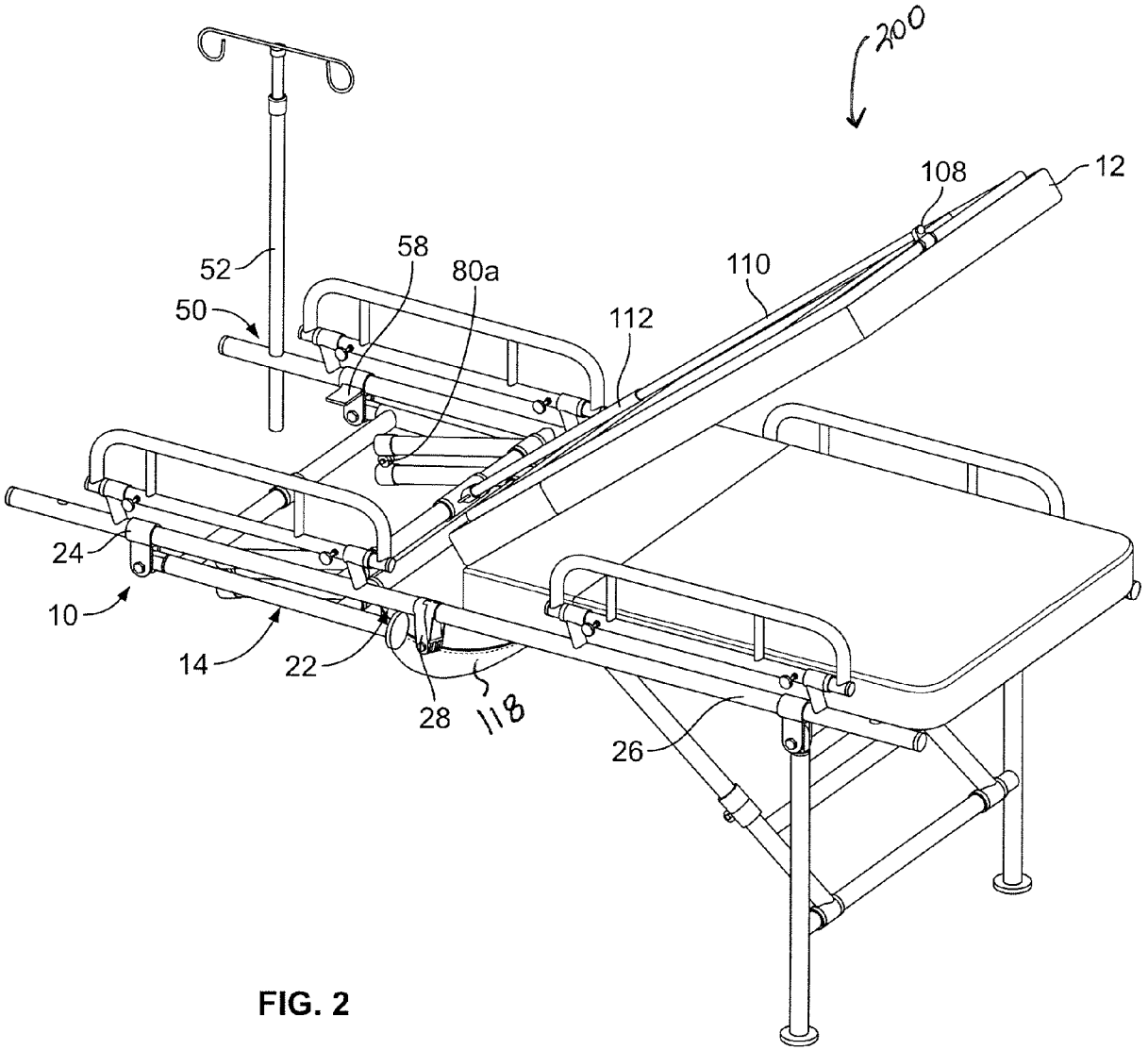
FIG. 2 is a perspective view of the invention.

The pad can include pad sections 12*a* through 12*d* as shown in FIG. 2. Therefore the pad can have a proximal (head) end and a distal (foot) end that can be rotated 180 degrees so that the ends are interchangeable The pad section can be hingeably connected to each other by hinges 16*a* through 16*c*. In one embodiment, pad section 12*b* is about the same size as pad section 12*c* and pad section 12*a* is about the same size as section 12*d*. Therefore the head (pad section 12*a*) and foot (pad section 12*d*) allow the pad to be rotated 180 degrees on the frame.

In one embodiment of pad 12, an outer cover defines pad pockets. Seams can be included in the outer cover of the pad and can further define the pad pockets. Cushion materials can be disposed within the pad pockets to provide a cushioned surface for the field bed. The cushion material can include foam, feathers, cotton, wool, cloth, batting and can be natural or synthetic.

Figure 3:
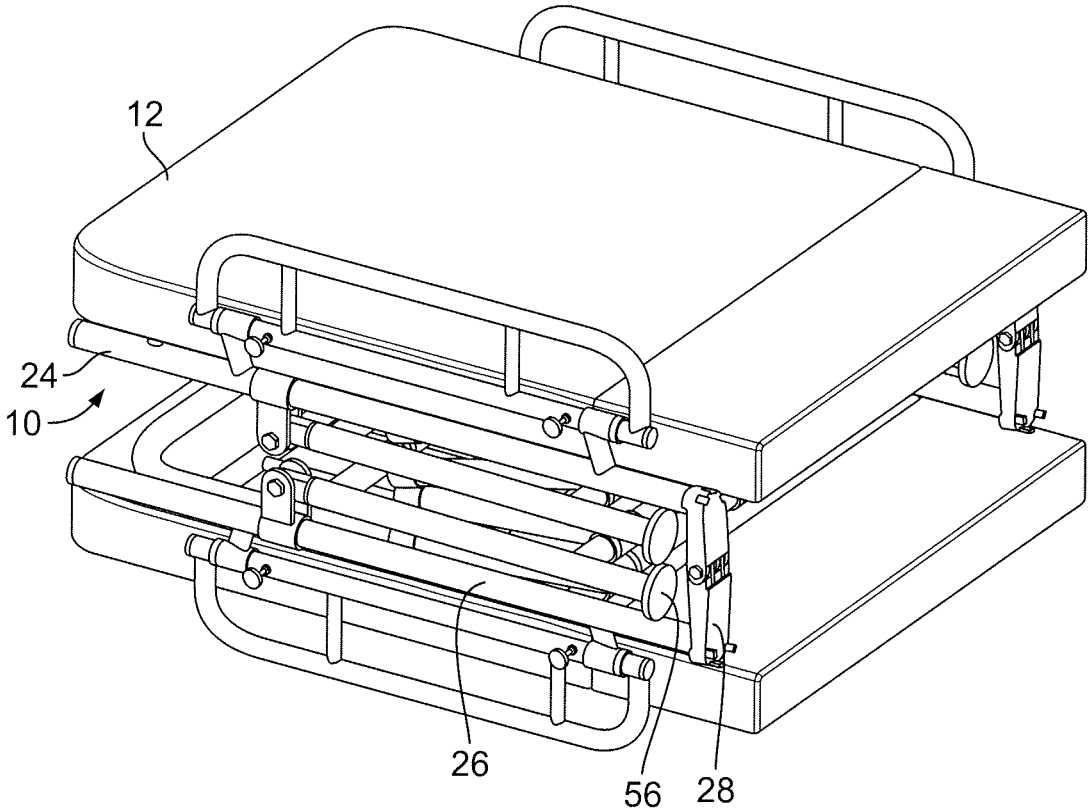
FIG. 3 is a perspective view of the invention.

One of the pad support assemblies can be a head section 24 with the other pad support assembly being a foot section 26. The pad support assemblies can be rotatably connected to a respective horizontal support assembly and can be moved from a operational position to s stored position. The left and right horizontal support assemblies can be pivotally connected by hinge 28. In the operational position, the left and right horizontal support assemblies are arranged generally parallel to each other as well as the ground. In the stored position, the left support assembly can be rotated so that it is folded over the right support assembly as shown in FIG. 3. The left and right vertical support assemblies are rotatably attached to the respective horizontal support assembles and in an operational position include a vertical support 54 that is generally perpendicular to the horizontal assembly in the operational position.

An angled vertical support 206 can be rotatably attached to each vertical support assemblies to add stability to the frame when in the operational position. In the stored position, the angled vertical support are hinged and folded under the horizontal supports. A vertical support 54 can be attached to the horizontal support assembly for supporting the pad above the ground or floor. A foot 56 can be attached to the distal end of the vertical support.

Referring to FIG. 2, the frame is shown having the pad support assembly rotated from horizontal in excess of 90 degrees. A standard 109 can be pivotally attached to the pad support assembly at one end and pivotally attached to the first angled support assembly cross member a the other end. The standard can include a first standard member 110 and second standard member 112 can telescope within each other to allow the par support assembly, and therefore the pad, to be raised from a horizontal position for supporting the patient in a more upright orientation. When in the storage position, the head section can pivot so that it is disposed over the foot section. The frame can then pivots about hinge 28 so that on half of the frame can be moved to a stored position shown in FIG. 3. The pad is also folded in this operation and disposed between the head and foot section in the stored position. One embodiment can include an accessory opening 50 in the horizontal assembly for receiving an accessory 52. The accessory shown is an IV bag holder. A pad support frame 58 can be included in the pad support assembly to assist in supporting the pad on the frame.

Referring to FIG. 3, the invention in is shown in its stored position. The hinge allows the two halves to be folded about each other with the pad support assemblies, horizontal support assemblies and vertical support assemblies folded within each other for reducing the footprint of the frame for transportation and storage. The angled support assemblies are fold generally in the middle and are disposed with the areas of the horizontal support assembly in the storage position. The horizontal support assemblies are folded against the vertical support assemblies and are disposed between the vertical support assemblies when in the storage position. The pad can be transported alongside the frame in the storage position for a more compact transportation arrangement.

Figure 4:
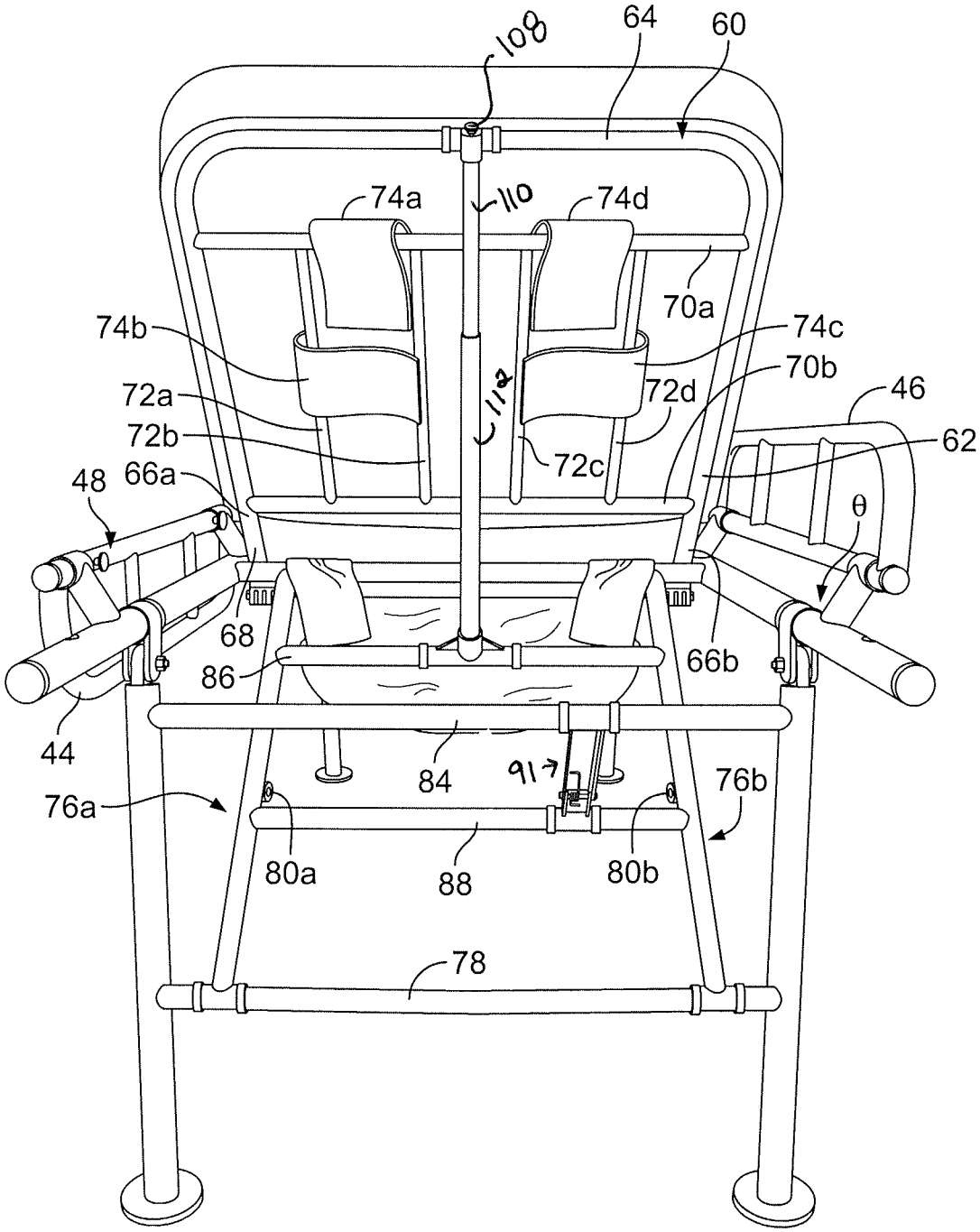
FIG. 4 is rear view of one end of the invention.

Referring to FIG. 4, pad support section 60 included in the pad support assembly is shown. This section includes a pad support frame 62 having a top member 64, a left and right member 66*a* and 66*b* and bottom pivot member 68. The bottom pivot member is notably connected to the horizontal support assembly. This allows the pad support section to rotate from a raised position as shown in FIG. 1 to a lowered position where the pad support section is generally parallel to the ground. A plurality of cross members 70*a* and 70*b* can be attached to the pad support frame. A plurality of vertical members 72*a* through 72*d* can be attached to the cross members to provide further support to the pad support frame. Pad securing members 74*a* through 74*d* can be attached to the pad to allow the pad to be removable attached to the pad support section as well as allow the pad to remain affixed to the pas support frame independent of the orientation of the pad support section's position.

The vertical support assembly can include lower support members 76*a* and 76*b* that can be attached to the angled vertical support assemble and a lower horizontal support cross member 78 can also be attached to the angled vertical support assembly. The angled vertical support assemble can include hinges 80*a* and 80*b* allowing the angled vertical support assembly to fold when the vertical support assembly is moved from the operational position to the stored position. A stabilization assembly 91 is included in the angled support assembly having a locked position to prevent the unintentional collapsing of the vertical support assembly and a storage position where the stabilization assembly is unlocked and allows the vertical support assembly to more to its storage position. The angled support assembly can include an first angled assembly cross member 84 and a second angled support assembly cross member 86. The vertical support assembly can include a first vertical support assembly cross member 78 and a second vertical support assembly cross member 88.

An extendable locking support can be included in the pad support section that includes an actuator 108. When released, the activator disengages the extendable locking support allowing the pad support section to be lowered. When the pad support section is raised, the extendable locking support is engaged and locks the pad support section in the raised position. The end of the extendable locking support can be pivotally attached to the top member. In one embodiment, the extendable locking support includes a first standard 110 and a second standard 112 where the first standard is slidably received in the second standard allowing the length of the extendable locking member to vary as the pad support section transitions from the lowered position to a raised position. The second standard can be pivotally attached to a lower cross member 86 included in the angled support assembly.

Figure 5:
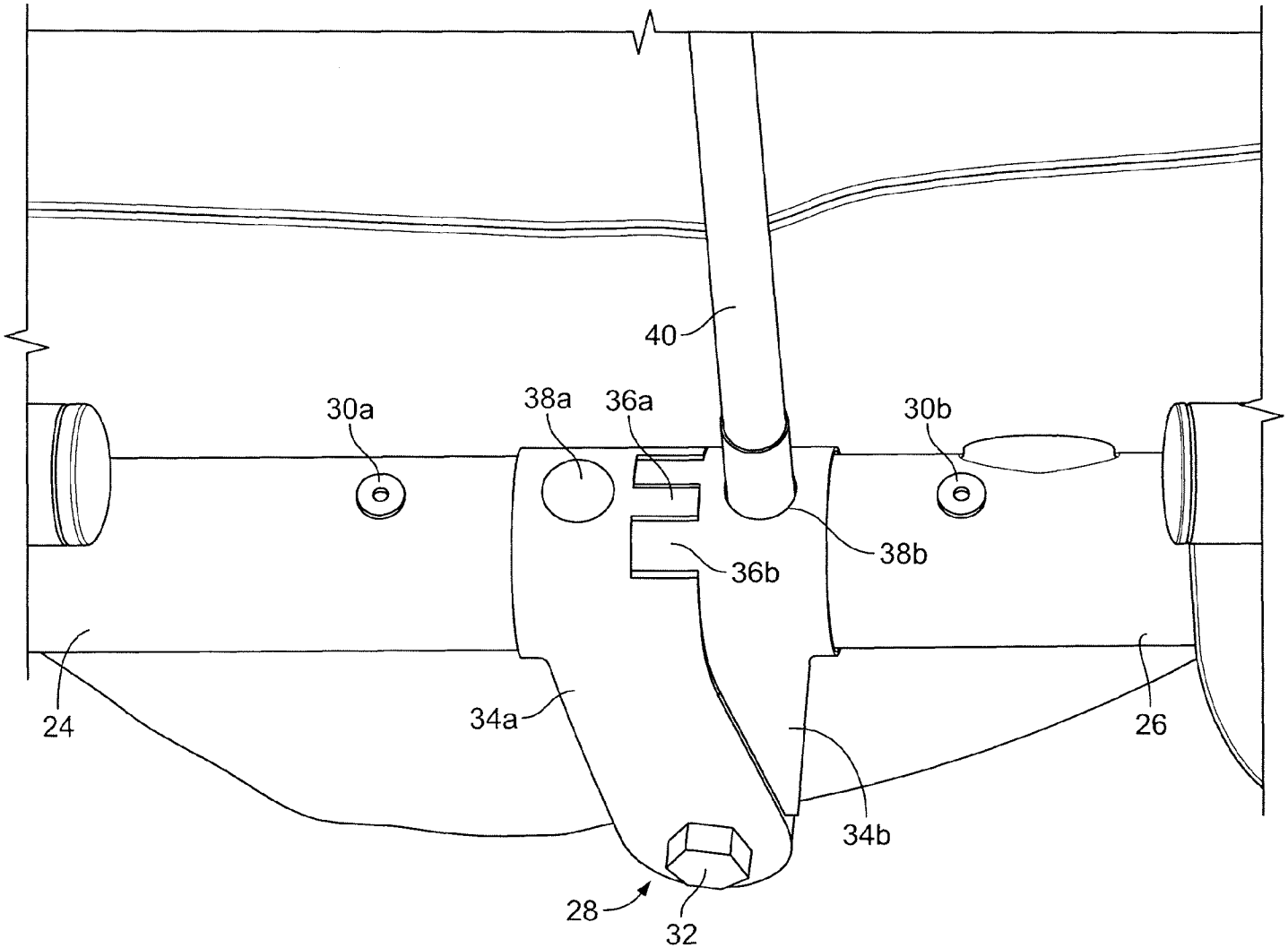
FIG. 5 is a perspective view of one aspect of the invention.

Referring to FIG. 5, hinge 28 is shown attached to the head section with fasteners 30*a* and fastener 30*b*. Pivot 32 allows first hinge section 34*a* and second hinge section 34*b* to rotate about pivot 32. The first hinge section can include teeth 36*a* which interlock with teeth 36*b* when the hinge is in an extended position where the head section and front section are generally parallel to increase stability of the frame. In one embodiment mid-frame accessory openings 38*a* and 38*b* can be defined in the hinge to receive accessory 40 such as a table, IV pole or other accessory.

Figure 6:
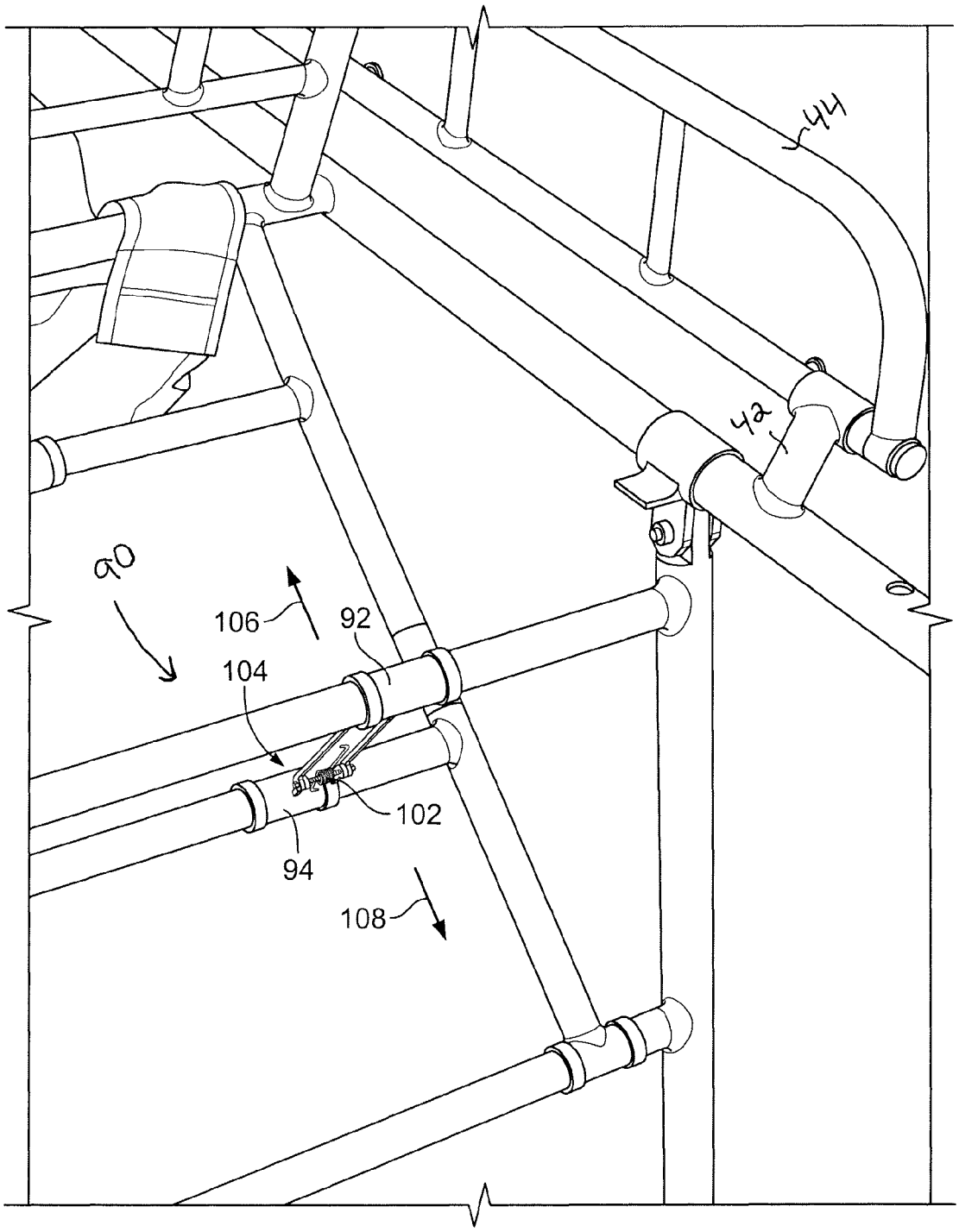
FIG. 6 is a perspective view of one aspect of the invention.

Referring to FIG. 6, the stabilization assembly is shown in further detail. The stabilization assembly can include a locking hinge 90 that can be pivotally attached to upper vertical support cross member and the second lower support cross member. An proximal end 92 can be included in the stabilization assembly and can be pivotally connected to the first lower support cross member and distal end 94 pivotally connected to the second lower support cross member. A first hinge member 96 is pivotally connected to a second hinge member 98. In one embodiment, hinge pin 100 connects the first and second hinge members. A biasing member 102 functions to bias the first and second hinge members in a locked position. Abutting edges 104 of the first and second hinge members assists in preventing over rotation of the hinge members about the hinge pin. In one embodiment the biasing member is a spring. The biasing member biases the first and second hinge members in direction shown as 108. While the abutting edges stop the hinge support members from over rotating in direction shown as 108. When the angled support assembly in the stored position, the hinge folds in a direction shown as 106 allowing the angled support assembly to be transformed from an operational position to the stored position.

The horizontal support assembly can include a side rail support 42 attached to a horizontal member of the frame. Multiple side rail supports can be connected to the outer sides of the horizontal support assemblies. Each side rail support can have a side rail 44 pivotally attached. When in an upright position the side rail can assist in preventing an individual from falling off the pad. The right head side rail 46 is shown in the upright position while left head side rail is in a lowered position. The lowered position allows an individual easier ingress and egress to the pad. In one embodiment, the side rail supports are attached at an angle from perpendicular. In this embodiment an angle exists between the axis of the side rail support and a perpendicular plane that is parallel to the horizontal support assembly.

Figure 7:
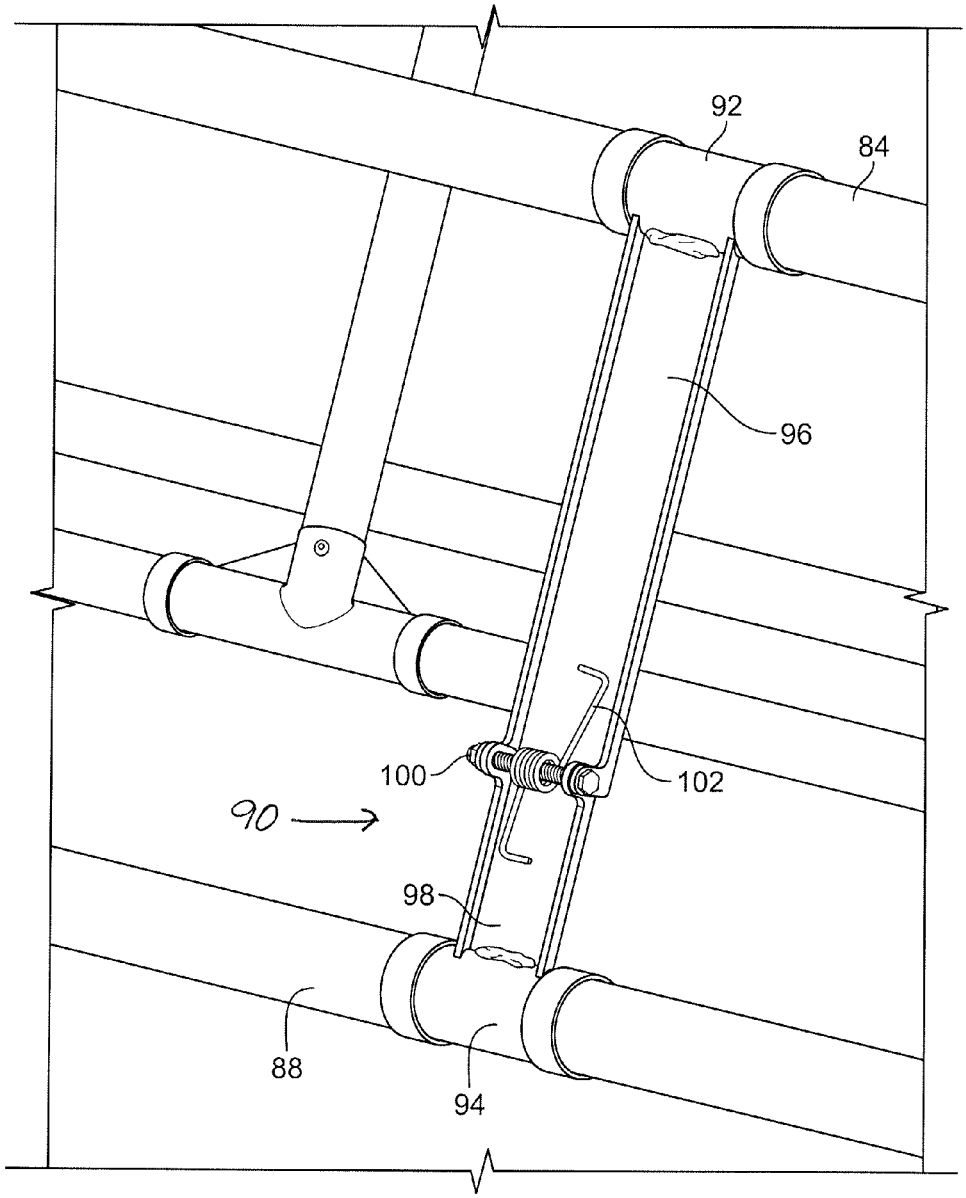
FIG. 7 is a perspective view of one aspect of the invention.

In one embodiment, side rail lock assembly 48 is included in the side rail to secure the side rail in raised position. When activated, the lock assembly allows the side rail to rotate to the lowered position. When the side rail is raised from the lowered position to the raised, the back assemble engage and secures the guard rail in the raised position. Referring to FIG. 7, the stabilization assembly is shown in more detail.

A side mount pouch having a plurality of pockets can be removable attached to the frame for holding various articles. Referring to FIG. 1, a lower pouch 114 can be attached under the frame generally at the mid-way point of the frame for holding various articles. The lower second punch can be used for receiving personal effects of a patient. A table can removable attached to the horizontal support assembly and can include a table support 120 pivotally attached to a table surface 122. The table can be removed from the frame and the table support rotated under the table surface for more compact storage and transportation.

The actual scope of the invention encompasses not only the disclosed embodiments above, but also all equivalent ways of practicing or implementing the invention. The above detailed description of the embodiments of the invention is not intended to be exhaustive or to limit the invention to the precise form disclosed above or to the particular field of usage mentioned in this disclosure.

What is claimed is:

1. A portable collapsible field hospital bed comprising:

a frame having a horizontal support assembly and a pad support assembly wherein said frame has an operational position and a storage position;

a vertical support assembly pivotally attached to an angled support assembly and said horizontal support assembly, said vertical support assembly including a first vertical support assembly cross member and a second vertical support assembly cross member, said angled support assembly including a first angled support assembly cross member and a second angled support assembly cross member;

a pad for supporting a patient carried by said pad support assembly;

a stabilizing assembly having a first hinge member pivotally attached to said second vertical support assembly cross member and a second hinge member, said second hinge member pivotally attached to said second angled support assembly cross member, said stabilizing assembly biased in an operation position by a biasing member included in said stabilizing assembly; and, a standard having a first standard member received within a second standard member so that said first standard member and said second standard member telescope, said first standard member pivotally attached to said pad support assembly and said second standard member attached to said first angled support assembly cross member.

2. The apparatus of claim 1 including an actuator for said standard having a locked position and an unlocked position wherein in said unlocked position, said first standard member and said second standard can slide within each other to vary the overall length of said standard.

3. The apparatus of claim 1 including side rails carried by said horizontal support assembly wherein said side rails can be lowered to allow access to the pad by a patient.

4. The apparatus of claim 3 including angled side rail supports attached to said horizontal support assembly and pivotally attached to said side rails.

5. The apparatus of claim 4 wherein said angled side rail supports are disposed at an angle greater than 90° to a plane perpendicular to said horizontal support assembly.

6. The apparatus of claim 4 including a side rail lock assembly for locking said side rail in the raised position.

7. The apparatus of claim 1 wherein:

said frame includes a proximal end and a distal end; and, a hinge pivotally connecting said proximal end with said distal end so that in said frame can be moved between said operational position and said storage position.

8. The apparatus of claim 7 including interlocking teeth in said hinge to provide stability to said frame when said frame is in said operational position.

9. The apparatus of claim 1 including:

an accessory opening defined in said horizontal support assembly for receiving accessories; and, an IV pole accessory received in said accessory opening for support IV bags.

10. The apparatus of claim 1 including a mid-frame accessory opening for receiving an accessory and a tray removably received in said mid-frame accessory opening to provide a horizontal surface for the patient supported by the pad.

11. A portable collapsible field hospital bed comprising:

a frame having a horizontal support assembly, an operational position and a stored position;

a vertical support assembly pivotally attached to an angled support assembly and said horizontal support assembly, said angled support assembly pivotally attached to said horizontal support assembly;

a pad for supporting a patient carried by said pad support assembly; and, a stabilizing assembly included in said angled support assembly having a first hinge member pivotally attached to a second hinge member, said stabilizing assembly biased in said operational position by a biasing member included in said stabilizing assembly.

12. The apparatus of claim 11 including a lower pouch carried by said frame and disposed under said frame.

13. The apparatus of claim 12 wherein:

said frame includes a proximal end and a distal end;

a hinge pivotally connecting said proximal end with said distal end so that in said frame can be moved between said operational position and said storage position; and, interlocking teeth included in said hinge to provide stability to said frame when said frame is in said operational position.

14. The apparatus of claim 12 including:

an accessory opening defined in said horizontal support assembly for receiving accessories; and, an IV pole accessory received in said accessory opening for supporting IV bags.

15. A portable collapsible field hospital bed comprising:

a frame having a horizontal support assembly including a proximal end and a distal end hingably connected so that the proximal end and the distal end can be moved from an operational position to a storage position;

a vertical support assembly pivotally connected to an angled support assembly and said horizontal support assembly, said angled support assembly pivotally connected to said horizontal support assembly;

a stabilizing assembly included in said angled support assembly having a first hinge member pivotally attached to a second hinge member, said stabilizing assembly biased in said operational position by a biasing member included in said stabilizing assembly, said first hinge member cooperating with said second hinge member to prevent said angled support assembly from folding.

16. The apparatus of claim 15 including pad support assembly that can be raised from a horizontal position to support the head or feet of a patient supported by the frame.

17. The apparatus of claim 16 including a pad removable connected to said pad support assembly having a proximal end and a distal end that can be interchanged about the frame.

18. The apparatus of claim 15 including a mid-frame accessory opening for receiving an accessory.

19. The apparatus of claim 15 including an accessory opening defined in said horizontal support assembly for receiving accessories.

20. The apparatus of claim 19 including an IV pole accessory received in said accessory opening for support IV bags.

* * * * *